United States Patent [19]

Harris

[11] 4,094,106

[45] June 13, 1978

[54] HONING DEVICE

[75] Inventor: Thomas D. Harris, Jonesboro, Ga.

[73] Assignee: Southern Saw Service, Inc., Atlanta, Ga.

[21] Appl. No.: 730,781

[22] Filed: Oct. 8, 1976

[51] Int. Cl.[2] ..... B24D 15/06

[52] U.S. Cl. ..... 51/214; 76/88

[58] Field of Search ..... 51/205 WG, 211 R, 212, 51/214, 239, 285, DIG. 15; 76/82, 82.2, 84, 88, 89

[56] References Cited

U.S. PATENT DOCUMENTS

| | | | |
|---|---|---|---|
| 21,058 | 8/1858 | Armstrong | 76/88 |
| 1,075,690 | 10/1913 | Buck | 51/214 |
| 1,158,048 | 10/1915 | Hawks | 51/205 WG |
| 1,269,272 | 6/1918 | Floback | 51/214 |

FOREIGN PATENT DOCUMENTS

| | | | |
|---|---|---|---|
| 621,715 | 4/1949 | United Kingdom | 76/84 |

*Primary Examiner*—Gary L. Smith

*Attorney, Agent, or Firm*—Newton, Hopkins & Ormsby

[57] ABSTRACT

A honing device consisting of a handle from which protrudes an elongated cylindrical hone. Adjacent the handle is a conical blade guide which establishes an appropriate angle at which to hold the knife for sharpening.

4 Claims, 3 Drawing Figures

HONING DEVICE

BACKGROUND OF THE INVENTION

1. Field of the Invention

This invention relates to a honing device and is more particularly concerned with a hand-held hone which will establish the angle at which a knife is to be sharpened.

2. Description of the Prior Art

In the past, numerous devices have been employed for sharpening knives. Probably the most popular of these is a hand-held hone which is either a ceramic hone or a steel hone. Such honing devices are usually held in one hand as a knife is passed outwardly or inwardly along the body of the sharpener. To provide a sharp edge, the angle at which the blade of the knife should be honed is approximately 15° to 20°. Therefore, it is necessary for the operator to estimate the angle at which the knife is to be held. Thus, at times, the bevel imparted to the cutting edge of a knife will not be the optimum.

The present invention provides an apparatus and method for honing knives which will eliminate the guess work as to the angle at which the knife should be sharpened.

SUMMARY OF THE INVENTION

Briefly described, the present invention includes a handle or hilt which carries an elongated, preferably cylindrical, hone which is tapered toward its distal end. The innermost portion of the handle is relatively wide, protruding beyond the periphery of the sharpening element or hone. The proximal end portion of the sharpening element is provided, adjacent the hilt, with a knife guide which has a conical surface tapering toward the periphery of the sharpening element. Thus, by placing a knife against the guide, the angle at which the knife is sharpened is readily and easily established.

DESCRIPTION OF THE PREFERRED EMBODIMENT

Figure 1:
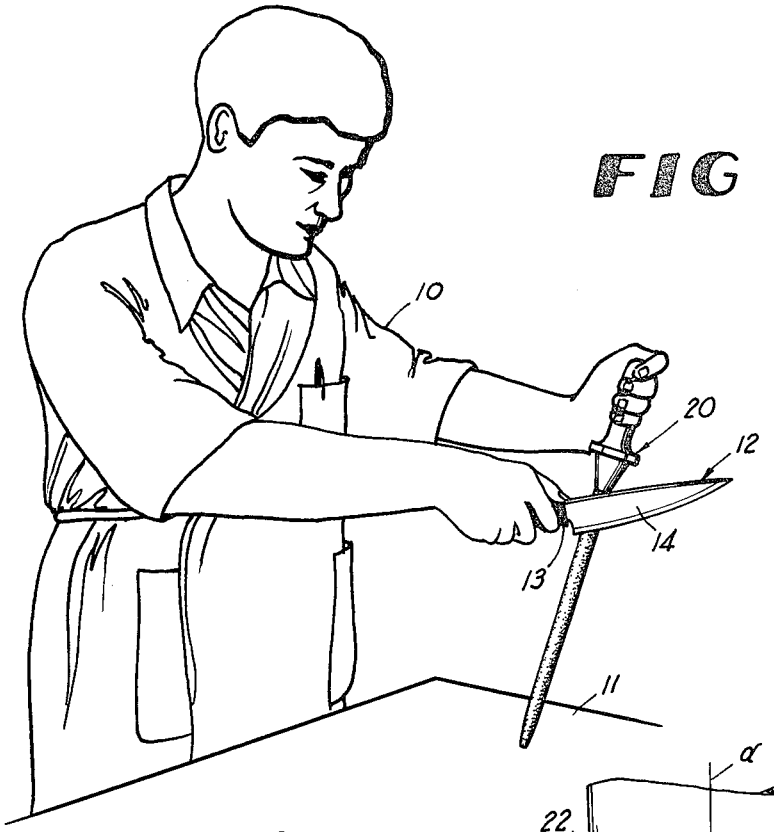
FIG. 1 is a side elevational view of an operator standing adjacent a table and sharpening a knife, utilizing the honing device of the present invention.
Figure 2:
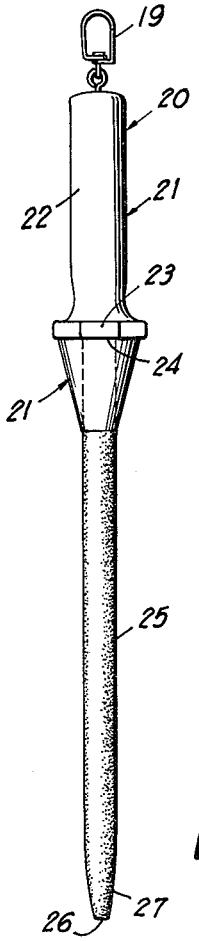
FIG. 2 is an enlarged side elevational view of the honing device depicted in FIG. 1.

Referring now in detail to the embodiment chosen for the purpose of illustrating the present invention, numeral 10 denotes, generally, the operator, such as a butcher, who is standing adjacent to the fixed upper horizontal surface of a table or chopping block 11 and is holding in one hand a knife 12 provided with a handle 13 and a blade 14. The honing device of the present invention, denoted generally by numeral 20, is held by its hilt or handle 21 in the other hand. The handle 21 has a cylindrical body 22 and a octagonal base member 23. The base 24 of base member 23 is flat and is disposed radially with respect to the cylindrical body 22. The upper end of the handle is provided with a swiveled bail 19 by means of which the handle 21 can be suspended from a flexible rope or cable (not shown).

The base member 23 is substantially larger in diameter than the handle 21 and hence the hand of a person, applying pressure downwardly on the handle 21, would not slip past the base member 23. Embedded by its proximal end portion in and protruding outwardly from the base member 23 of the handle 21 is an elongated cylindrical sharpener, hone or sharpening element 25 which is disposed coaxially with the handle 21, its proximal end being recessed into the lower end portion of the handle 21. The hone or sharpening element 25, while being illustrated as cylindrical, nevertheless may be of any shape desired. For example, the cross section may be triangular so as to provide a flat surface rather than a rounded surface to the knife blade 14.

The distal end 26 of the hone 25 is flat and is disposed in a radial plane. Adjacent the distal end 26, the hone 25 is conical, tapering toward the end 26, as at numeral 27.

Figure 3:
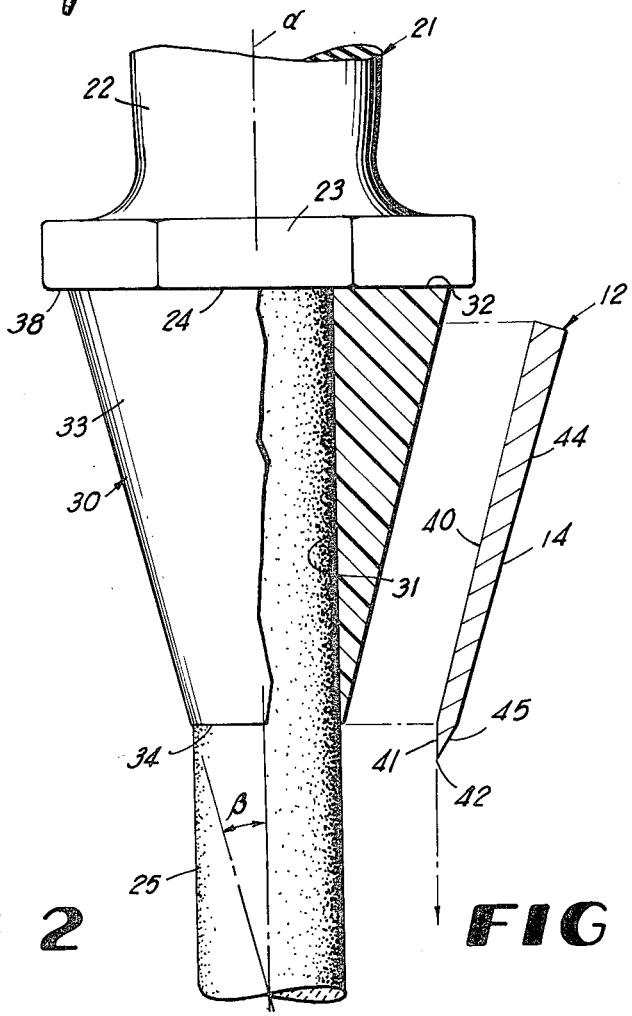
FIG. 3 is a further enlarged, fragmentary elevational view showing the central portion of the honing device depicted in FIG. 1 and a cross section of a knife disposed adjacent to the knife guide.

According to the present invention, a knife guide, denoted generally by numeral 30, is carried by, being disposed around, the proximal end portion of the hone 25, as best seen in FIG. 3. This knife guide 30 is a frustoconical member preferably formed of strong plastic, such as nylon or ABS. The knife guide 30 has a central cylindrical bore 31 which conforms to the shape of the hone 25 and is press fitted, thereover. The major base 32 of the knife guide 30 is perpendicular to the axis of bore 31 and is flat and radially disposed, so as to be contiguous with the base 24 of the handle or hilt 21.

The inclined surface 33 of the knife guide 30 is conical, throughout the length of the knife guide 30, for purposes to be described, hereinafter. It may, however, have flat converging surfaces, if desired. The lower end of the conical surface and the surface defining the bore 31 taper or converge toward distal end 26 to converge at a circular lower edge 34 disposed in a radial plane. The major diameter of the knife guide 30, at the surface 32, is slightly less than the diameter of the base 24 so that a peripheral portion of base 24 forms an overlapping ledge 38. Ledge 38 forms an upper stop or abutment for the arresting upward movement of the knife 12.

The diameter of the lower edge 34 is approximately equal to the diameter of the hone 25.

It is thus seen that the radially disposed base 24 of handle 21 protrudes outwardly beyond the knife guide 30 while the surface 33 of the knife guide 30 converges toward the periphery of the hone 25, throughout the surface 33.

Adhesive, or simply friction maintains the knife guide 30 in the position depicted in the drawings. The hone 25 is substantially longer than the handle 21 and the flat radially disposed base 26 is of substantially smaller diameter than the diameter of the hone 25. Also, the hone 25 is substantially longer than the knife guide 30. The length of the handle 21 is sufficient that it can be readily and easily grasped in a person's hand as depicted in FIG. 1. The length, i.e., height, of the knife guide 30 is greater than the width of a conventional knife blade 14 so that the entire width of the flat side 40 of the knife blade 14 may be positioned against the conical surface 33 and be disposed between the base 32 and end 34, as depicted by broken lines in FIG. 3.

The angle $\beta$ subtended by the surface of knife guide 30 with respect to the longitudinal axis $\alpha$ of the honing device must be maintained between approximately 10° and approximately 30°. Indeed, it is quite critical that the angle $\beta$ be 15° plus or minus 5°. The reason for this is that the surface 33 positions the knife 12 for receiving the bevel 41 or 45 which forms a sharp edge 42. It is important in sharpening knives that the bevel 41 be between about 15° and 20°. By making the angle $\beta$ 15°, there is a reasonable assurance that the knife surface will be disposed at approximately 15° to the axis of the honing device; however, the angle may be slightly greater but is usually not slightly less than the angle $\beta$.

OPERATION

From the foregoing description, the operation of the present device should be apparent. The honing device 20 is preferably held in one hand of the operator 10 by its handle 21 so that the distal end 26 rests firmly on the surface of the chopping block 11. The knife 12, to be sharpened, is held by its handle 13 in the other hand of the operator. The blade 14 is then disposed with its side 40, flat along the surface 33, as depicted in FIGS. 1 and 3. The blade 14 then is moved downwardly as the point or distal end 26 of the hone 25 is urged against the surface of block 11 so as to establish a relatively fixed position for the hone 25. Since the surface 33 has established the angle $\beta$ at which the knife 12 is to be held, the knife 12 remains held at the prescribed angle $\beta$ and is moved downwardly along hone 25 in the usual way, the hone 25 engaging only the bevel 41 (or 45) as the knife blade 14 is moved downwardly and across the hone 25.

The same procedure is then repeated with surface 44 being initially positioned against the surface 33, then moved along the hone 25 so as to permit honing of the bevel 45.

The handle 21 and blade guide 30 can be molded as a single integral or unitary piece, if desired, or the handle 20 and blade guide 30 can be two abutting pieces joined at any angle to the base 31 to give the tightest possible fit between base 24 and handle 21.

It should be understood that the just described embodiment merely illustrates principles of the invention in preferred form. Many modifications, deletions and additions may, of course, be made thereto without departure from the spirit and scope of the invention as set forth in the following claims.

What is claimed is:

1. A honing device comprising, a handle, an elongated generally cylindrical hone secured by its proximal end to and projecting from said handle, said hone having an exposed and unobstructed peripheral sharpening surface extending from the vicinity of said handle throughout substantially its entire length to its distal end, and a knife guide disposed between said handle and said exposed surface of said hone, said guide having a large major base adjacent to said handle and a small minor base adjacent to said exposed surface of said hone, the surface of said guide tapering toward said hone from its major base adjacent to said handle to its minor base adjacent said surface for establishing the angle at which the cutting edge portion of a knife will pass unimpeded axially from the guide to and thence axially along the length of said exposed surface of said hone, said guide at its minor base being of approximately the same diameter of said hone.

2. The honing device defined in claim 1 wherein the angle between the axis of said honing device and the surface of said knife guide is between 10° and 30°.

3. The honing device defined in claim 1 wherein said knife guide is a frusto-conical member having a central bore, said hone protruding through said bore, the major base of said knife guide abutting the base of said handle, and the smallest diameter portion of said guide corresponding to the diameter of said hone.

4. The honing device defined in claim 3 wherein said hone, at its distal end portion, is tapered and provided with a distal end which is of reduced diameter for engagement with the surface of a chopping block.

* * * * *